US011285745B2

(12) United States Patent
Yato et al.

(10) Patent No.: US 11,285,745 B2
(45) Date of Patent: Mar. 29, 2022

(54) RECORDING DEVICE

(71) Applicant: SEIKO EPSON CORPORATION, Tokyo (JP)

(72) Inventors: Keiichi Yato, Matsumoto (JP); Atsuhiko Takeuchi, Matsumoto (JP); Yosuke Nakano, Matsumoto (JP); Shun Ito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/827,285

(22) Filed: Mar. 23, 2020

(65) Prior Publication Data

US 2020/0307289 A1 Oct. 1, 2020

(30) Foreign Application Priority Data

Mar. 25, 2019 (JP) ..... JP2019-056249

(51) Int. Cl.
*B41J 2/15* (2006.01)
*B41J 29/02* (2006.01)
*B41J 2/01* (2006.01)

(52) U.S. Cl.
CPC ..... *B41J 29/02* (2013.01); *B41J 2/01* (2013.01)

(58) Field of Classification Search
None
See application file for complete search history.

(56) References Cited

U.S. PATENT DOCUMENTS 8,215,765 B2 * 7/2012 Murase ..... B41J 29/02 347/108
2007/0171269 A1 7/2007 Murase
2014/0146105 A1 * 5/2014 Nakada ..... B65H 23/08 347/16
2015/0077457 A1 * 3/2015 Nakada ..... B41J 2/32 347/16

FOREIGN PATENT DOCUMENTS

| | | | |
|---|---|---|---|
| CN | 208317421 U | * | 1/2019 |
| JP | 02216302 A | * | 8/1990 |
| JP | 11255383 A | * | 9/1999 |
| JP | 2005-017647 | | 1/2005 |
| JP | 2007-196487 | | 8/2007 |

OTHER PUBLICATIONS

Gao, B; Garden lawn trimmer, has shell whose top part is provided with hanging rings, which are matched with hook and whose bottom is provided with discharging port, and ring support plate provided with rolling caster wheel; Jan. 4, 2019; ON (Year: 2019).*

* cited by examiner

*Primary Examiner* — Erica S Lin
*Assistant Examiner* — Tracey M McMillion
(74) *Attorney, Agent, or Firm* — Workman Nydegger

(57) ABSTRACT

A recording device includes a leg unit that supports a base frame of a main body from a side of an installation surface. The leg unit includes four contact units that can contact the installation surface at positions different from each other, and the four contact units are constituted by three reference contact units that form a reference plane for which a relative position with respect to the base frame is defined, and one movable contact unit that can adjust a position in a height direction, which is a direction orthogonal to the reference plane.

9 Claims, 6 Drawing Sheets

RECORDING DEVICE

The present application is based on, and claims priority from JP Application Serial Number 2019-056249, filed Mar. 25, 2019, the disclosure of which is hereby incorporated by reference herein in its entirety.

BACKGROUND

1. Technical Field

The present disclosure relates to a recording device.

2. Related Art

In the past, a recording device has been known that, by ejecting liquid such as ink onto a surface of a medium such as a sheet, records an image and the like on the surface of the medium. In such a recording device, as flatness of a holder supporting the medium at a site where the liquid is discharged is increased, better quality of an image can be obtained.

Incidentally, an installation surface on which the recording device is installed is rarely a complete flat surface, and there is unevenness. When distortion of the recording device is caused by the unevenness of the installation surface, distortion also occurs in the holder, and the image quality deteriorates. JP-A-2007-196487 discloses a recording device in which a deformation absorbing member is interposed between a main body for recording on a medium and a leg unit for supporting the main body from an installation surface, to reduce influence of unevenness of the installation surface on the main body.

However, in the recording device of JP-A-2007-196487, when a deformation amount that the deformation absorbing member can absorb is exceeded, the main body is greatly affected by the unevenness of the installation surface, and large distortion of the main body occurs.

SUMMARY

A recording device for solving the above-described problems is an recording device that includes a main body configured to rotatably hold, around a central axis of a core member, a roll body with a medium wound around the core member wherein the main body includes a recording unit configured to perform recording on the medium drawn from the roll body, and a leg unit configured to support the main body from an installation surface, wherein the leg unit includes contact units configured to contact the installation surface at positions different from each other, and the contact units include three reference contact units forming a reference plane for which a relative position with respect to the main body is defined, and one movable contact unit for which a position is adjustable in a height direction, which is a direction orthogonal to the reference plane.

DESCRIPTION OF EXEMPLARY EMBODIMENTS

An exemplary embodiment of a recording device will be described below with reference to the accompanying drawings. The recording device rotatably holds a roll body in which a medium is wound around a core member, and ejects liquid onto a surface of the medium drawn from the roll body, to record an image and the like on the medium. For example, the recording device is, for example, an ink jet-type large format printer that prints on a medium such as a sheet, by ejecting ink, which is an example of liquid. The large format printer is a printer capable of performing printing on a medium having a short side width of A3 (297 mm) or greater.

Figure 1:
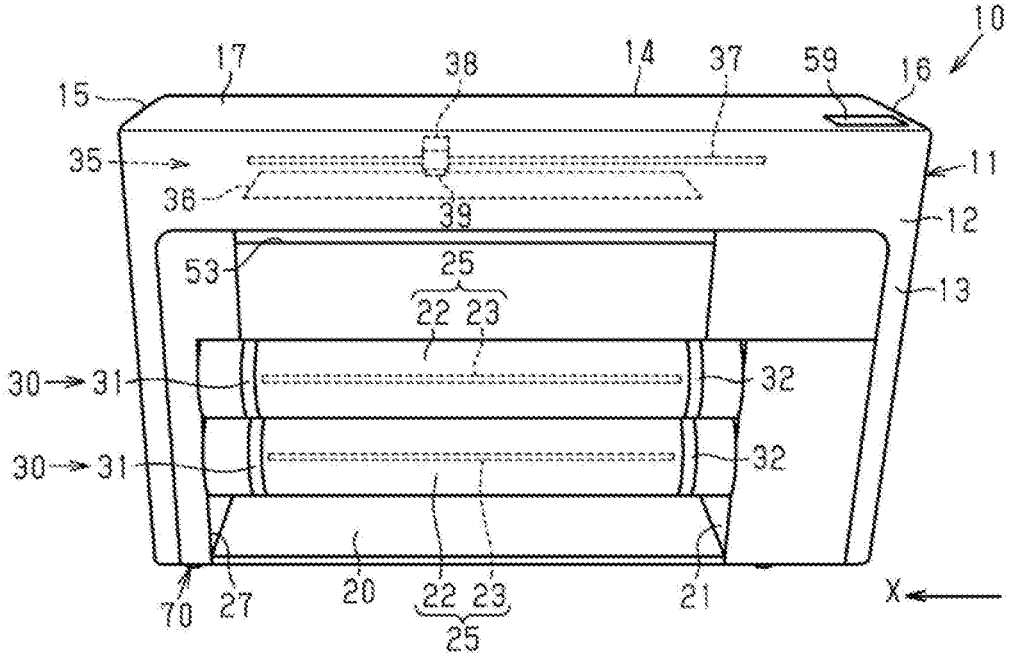
FIG. 1 is a front perspective view illustrating a schematic configuration of an exemplary embodiment of a recording device.

As illustrated in FIG. 1, a recording device 10 includes a main body 11 and a leg unit 70. The main body 11 includes a substantially rectangular parallelepiped housing 12. The housing 12 includes a front wall 13, a rear wall 14, a first side wall 15, a second side wall 16, and an upper wall 17. The housing 12 is coupled to a base frame 20 supported by the leg unit 70. In the recording device 10, a direction in which the base frame 20 and the upper wall 17 oppose to each other is referred to as a height direction of the recording device 10. In addition, a direction that is along a plane orthogonal to the height direction, and in which the first side wall 15 and the second side wall 16 oppose to each other is referred to as a width direction of the recording device 10. A direction that is orthogonal to the width direction in a plane orthogonal to the height direction, and in which the front wall 13 and the rear wall 14 oppose to each other is referred to as a front rear direction of the recording device 10. When the width direction and the front rear direction of the recording device 10 are arranged in a horizontal plane, the height direction is a direction parallel to a gravitational direction. Note that, in FIG. 1 to FIG. 10, the width direction of the recording device 10 is denoted by X, the front rear direction is denoted by Y, and the height direction is denoted by Z. Additionally, in FIG. 1 to FIG. 10, a direction in which an arrow faces is defined as positive direction, and one side of the width directions X is denoted as +X or the like.

Figure 2:
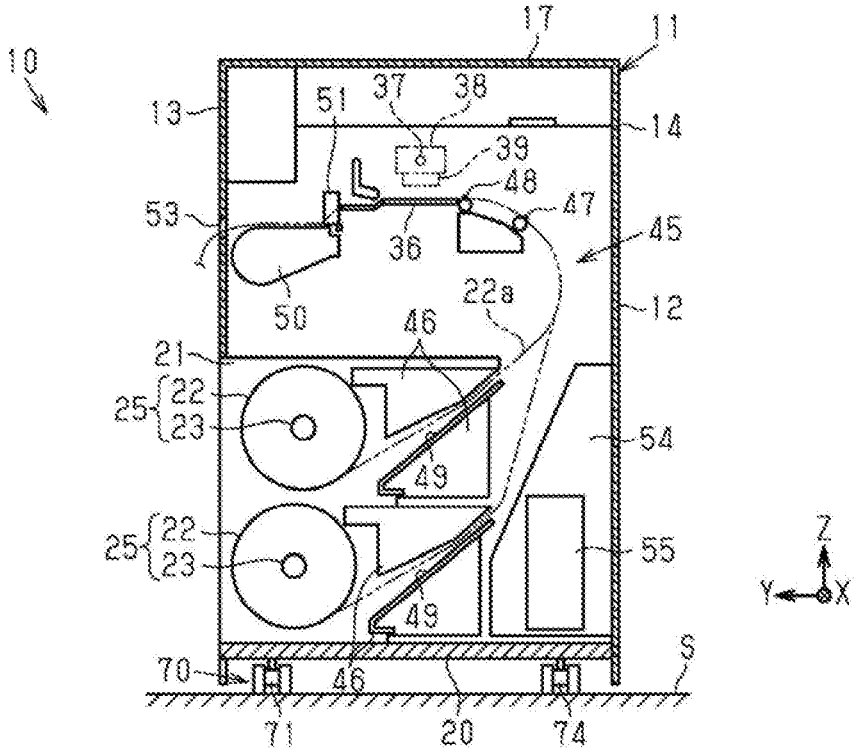
FIG. 2 is a cross-sectional view schematically illustrating a portion of internal structure within a housing.

As illustrated in FIG. 1 and FIG. 2, the main body 11 includes a housing unit 21. The housing unit 21 houses a cylindrical roll body 25 in which a medium 22 on which the main body 11 records is wound around a core member 23.

The housing unit 21 includes an opening 27 on a side of the base frame 20 in the front wall 13 of the housing unit 12, and extends from the front wall 13 toward the rear wall 14. In the present exemplary embodiment, the housing unit 21 is configured to be able to house a pair of the roll bodies 25 in a state of being aligned in the height direction Z of the recording device 10.

Figure 3:
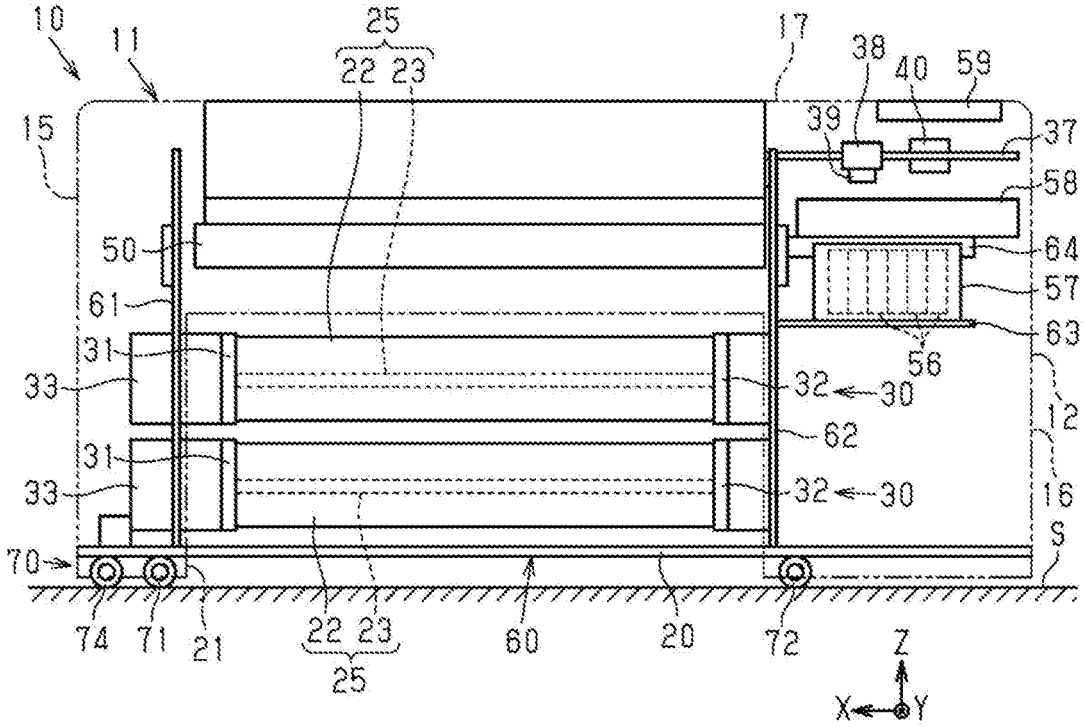
FIG. 3 is a front view schematically illustrating a portion of the internal structure within the housing.

As illustrated in FIG. 1 to FIG. 3, a pair of holding units 30 that are rotatably attached to the main body 11 are attached to each of the pair of roll bodies 25 housed in the housing unit 21. The holding unit 30 includes a first holding unit 31 that holds one end of the roll body 25, and a second holding unit 32 that holds another end of the roll body 25. The first holding unit 31 and the second holding unit 32 are removable from the main body 11 through the opening 27. In a state in which the first holding unit 31 and the second holding unit 32 are attached to the main body 11, the first holding unit 31 and the second holding unit 32 are aligned in the width direction X of the recording device 10 in the housing unit 21. Specifically, when the first holding unit 31 is attached to the one end of the roll body 25 and the second holding unit 32 is attached to the other end of the roll body 25, and the roll body 25 is placed on the housing unit 21, the pair of roll bodies 25 are stabilized in a state in which the first holding unit 31 and the second holding unit 32 are aligned in the width direction X. The first holding unit 31 is rotatably attached to a first side frame 61 illustrated in FIG. 3 with an axis along the width direction X being a rotary axis. The second holding unit 32 is rotatably attached to a second side frame 62 illustrated in FIG. 3 with the axis along the width direction X being the rotary axis. The holding unit 30 rotatably holds the roll body 25 about a central axis of the core member 23, by the first holding unit 31 and the second holding unit 32 holding the roll body 25. The roll body 25 held by the first holding unit 31 and the second holding unit 32 is driven to rotate by a drive unit 33 illustrated in FIG. 3. The drive unit 33 is located closer to a side of the first side wall 15 than the first holding unit 31, and drives a driving motor forward (not illustrated) to rotate the first holding unit 31 and the second holding unit 32 in a direction in which the medium 22 wound around the roll body 25 is transported to a side of the rear wall 14 in the housing 12. The first holding unit 31 need not be removable from the first side frame 61. Additionally, the second holding unit 32 need not be removable from the second side frame 62.

As illustrated in FIG. 1 to FIG. 3, the main body 11 includes a recording unit 35 in the housing 12. The recording unit 35 includes a holder 36, a guide shaft 37, a carriage 38, and a recording head 39. The holder 36 is located closer to a side of the upper wall 17 than the housing unit 21. The holder 36 is a plate-like member extending in the width direction X in the housing 12. The medium 22 unwound from the roll body 25, after transported in the housing 12 to the holder 36, is transported on the holder 36 from a side of the rear wall 14 toward a side of the front wall 13.

The guide shaft 37 is located closer to a side of the upper wall 17 than the holder 36. The guide shaft 37 is a rodlike member extending in the width direction X. The guide shaft 37 movably supports the carriage 38 along the guide shaft 37. The carriage 38 is configured to be reciprocally movable along the guide shaft 37 by driving a carriage motor 40 illustrated in FIG. 3.

The recording head 39 is mounted on the carriage 38. The recording head 39 is located on a side of the holder 36 with respect to the carriage 38. The recording head 39 ejects liquid onto the medium 22 supported by the holder 36 to record on the medium 22.

As illustrated in FIG. 2, the main body 11 includes a transport unit 45 in the housing 12. The transport unit 45 transports the medium 22 unwound from the roll body 25 in cooperation with the holding unit 30. The transport unit 45 includes a transport path forming unit 46, an intermediate roller 47, and a transport roller 48.

The transport path forming unit 46 is provided corresponding to each of the pair of roll bodies 25. The transport path forming unit 46 is located on a side of the rear wall 14 with respect to each of the pair of roll bodies 25 housed in the housing unit 21. The transport path forming unit 46 forms a transport path 49 that guides a medium 22*a* transported from the roll body 25 by driving to rotate the holding unit 30 to a side of the rear wall 14 of the housing 12.

The intermediate roller 47 and the transport roller 48 transport the medium 22*a* passed through the transport path 49. Each of the intermediate roller 47 and the transport roller 48 is constituted by a driving roller and a driven roller that are a pair of rollers rotatably supported with axes along the width direction X as rotary axes respectively. Each of the intermediate roller 47 and the transport roller 48 sandwiches and supports the medium 22*a* from both front and back sides with the driving roller and the driven roller.

The transport unit 45 transports the medium 22*a* to the holder 36 via the transport path 49 and transports the medium 22*a* from a side of the rear wall 14 to a side of the front wall 13 on the holder 36, by driving a driving motor forward (not illustrated) to drive to rotate the intermediate roller 47 and the transport roller 48. Note that, FIG. 2 illustrates a state in which the media 22*a* are transported from both the pair of roll bodies 25, but in actual recording, the medium 22*a* is transported from only one of the pair of roll bodies 25.

As illustrated in FIG. 2, the main body 11 includes a paper exit member 50 and a cutting unit 51 in the housing 12. The paper exit member 50 is located on a side of the front wall 13 with respect to the holder 36, supports the medium 22 passed through the holder 36, and guides the medium 22 to a paper exit 53 formed in the front wall 13. The cutting unit 51 cuts the medium 22. The medium 22 cut by the cutting unit 51 is discharged from the paper exit 53.

Figure 4:
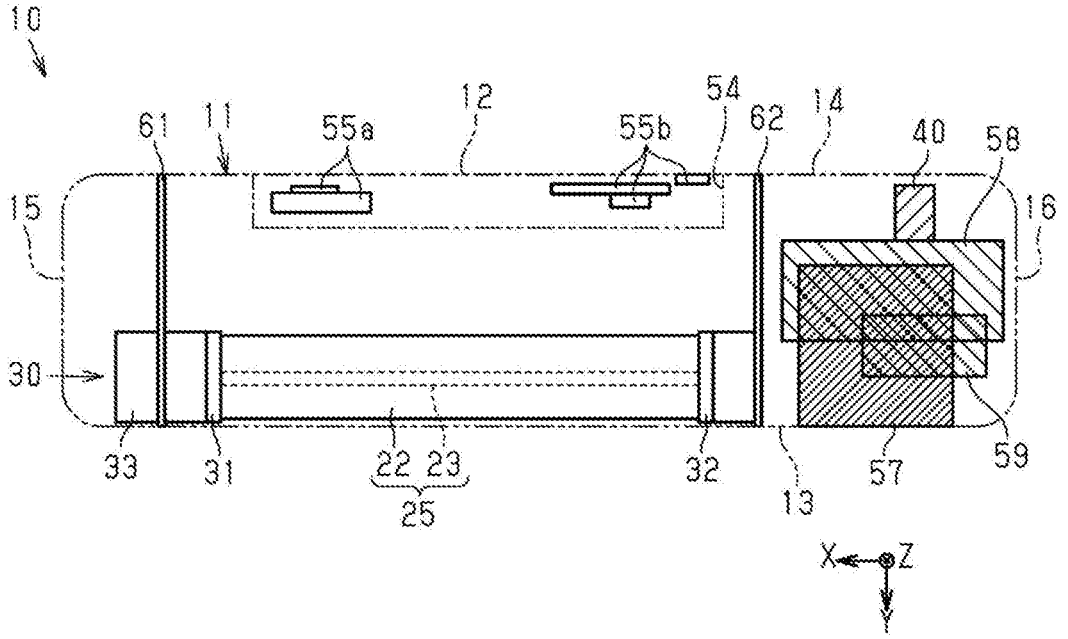
FIG. 4 is a diagram schematically illustrating a portion of structure within the housing in plan view in a height direction.

As illustrated in FIG. 2, the main body 11 includes a substrate storage chamber 54 in the housing 12. The substrate storage chamber 54 is a space located at a corner formed by the rear wall 14 and the base frame 20. Various substrates 55 are stored in the substrate storage chamber 54. The substrate storage chamber 54 is, as illustrated in FIG. 4, provided between the first side frame 61 and the second side frame 62 described later. In the substrate storage chamber 54, for example, in addition to two power supply substrates 55*a* that supply power to the recording device 10, three control boards 55*b* that control various control objects such as the transport unit 45 and the recording unit 35, and the like are stored. The power supply substrate 55*a* is disposed on a side of the first side frame 61 in a region between the first side frame 61 and the second side frame 62. The control board 55*b* is disposed on a side of the second side frame 62 in the region between the first side frame 61 and the second side frame 62.

As illustrated in FIG. 3 and FIG. 4, the main body 11 includes a mounting portion 57 on which a cartridge 56 containing liquid to be supplied to the recording head 39 is attached. The mounting portion 57 is located at a position closer to a side of the second side wall 16 than the first holding unit 31 and the second holding unit 32, and closer to a side of the upper wall 17 than the first holding unit 31 and the second holding unit 32. The cartridge 56 is coupled to the recording head 39 via a flexible tube (not illustrated). The cartridge 56 supplies liquid through the tube to the recording head 39, when a pressure of the liquid in the recording head 39 decreases associated with ejection of the liquid.

As illustrated in FIG. 3 and FIG. 4, the main body 11 includes a maintenance unit 58 that performs maintenance of the recording head 39. The maintenance unit 58 is located closer to a side of the second side wall 16 than the holding unit 30. The maintenance unit 58 is located at a position closer to a side of the upper wall 17 than the first holding unit 31 and the second holding unit 32, and closer to a side of the base frame 20 than the recording head 39. The maintenance unit 58 includes a portion located on a side of the upper wall 17 with respect to the mounting portion 57, that is, a portion overlapping with the mounting portion 57 in the height direction Z. In other words, the maintenance unit 58, in plan view in the height direction Z, overlaps with the mounting portion 57. The maintenance unit 58, for example, by reducing a pressure inside the recording head 39 by using a cap or an ejection pump (not illustrated), performs a cleaning operation in which liquid is discharged from the recording head 39.

As illustrated in FIG. 1, FIG. 3, and FIG. 4, the main body 11 includes an operation unit 59. The operation unit 59 is provided on the upper wall 17 of the housing 12. The operation unit 59 is located at a corner formed by a portion where the front wall 13 is coupled to the upper wall 17 and a portion where the second side wall 16 is coupled to the upper wall 17. The operation unit 59 is configured, for example, by a touch panel or the like, and is used by a user to input various types of information. The operation unit 59 includes a portion located on a side of the upper wall 17 with respect to the mounting portion 57, that is, a portion overlapping with the mounting portion 57 in the height direction Z. In other words, the operation unit 59, in plan view in the height direction Z, overlaps with the mounting portion 57.

As illustrated in FIG. 3, the main body 11 includes a frame body 60. In addition to the housing 12, the frame body 60 supports various members and units mounted on the main body 11, such as the holding unit 30, the recording unit 35, the transport unit 45, the mounting portion 57, and the maintenance unit 58 described above. The frame body 60 is configured to include the base frame 20, the first side frame 61, the second side frame 62, a first coupling frame 63, and a second coupling frame 64. A direction in which the first side frame 61 and the second side frame 62 are aligned is the width direction X of the recording device 10.

The base frame 20 extends in the width direction X in the housing 12 so as to form a bottom wall of the housing 12. The base frame 20 is supported from a side of the installation surface S by the leg unit 70.

The first side frame 61 is located closer to a side of the first side wall 15 than the housing unit 21. The first side frame 61 is coupled to the base frame 20 and extends from the base frame 20 in the height direction Z. The first side frame 61 rotatably supports the first holding unit 31 of the holding unit 30 with an axis along the width direction X as a rotary axis. In addition, the first side frame 61 supports the drive unit 33 that drives the holding unit 30. The drive unit 33 is located on an opposite side of the second side frame 62 with respect to the first side frame 61.

The second side frame 62 is located closer to a side of the second side wall 16 than the housing unit 21. The second side frame 62 is coupled to the base frame 20, and extends from the base frame 20 in the height direction Z. The second side frame 62 rotatably supports the second holding unit 32 of the holding unit 30 with an axis along the width direction X as a rotary axis.

The first coupling frame 63 is a member coupled to the second side frame 62 and located between the second side frame 62 and the second side wall 16. By the first coupling frame 63, the mounting portion 57 described above is supported. In other words, the mounting portion 57 is located at a position farther from the second side frame 62 on an opposite side of the first side frame 61 with respect to the second side frame 62, and is supported by the second side frame 62 via the first coupling frame 63.

The second coupling frame 64 is a member coupled to the second side frame 62 and located between the second side frame 62 and the second side wall 16. The second coupling frame 64 is located closer to a side of the upper wall 17 than the first coupling frame 63. By the second coupling frame 64, the maintenance unit 58 described above is supported. In other words, the maintenance unit 58 is located on an opposite side of the first side frame 61 with respect to the second side frame 62, and is supported by the second side frame 62 via the second coupling frame 64.

Figure 5:
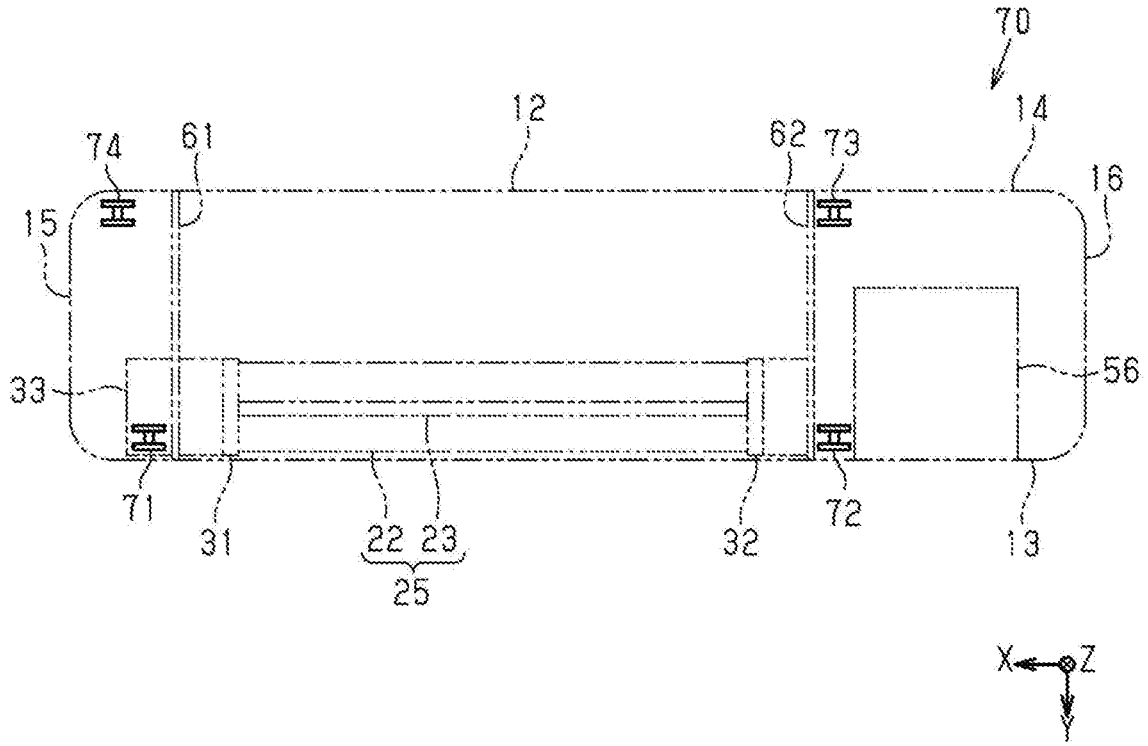
FIG. 5 is a view illustrating an arrangement of each support leg in plan view in the height direction.

As illustrated in FIG. 5, the leg unit 70 supporting the base frame 20 from the side of the installation surface S includes, as support legs each having a contact unit that can contact the installation surface S, a first caster 71, a second caster 72, a third caster 73, and a fourth caster 74. The first caster 71 to fourth caster 74 are disposed at respective different positions from each other in plan view in the height direction Z. The first caster 71 to fourth caster 74 each include a wheel that rolls in conjunction with movement of the recording device 10, and a wheel direction can be changed by rotating with an axis along the height direction Z as a rotary axis. Furthermore, the first caster 71 to fourth caster 74 each include a locking mechanism (not illustrated) that restricts the rotation of the wheel. The installation surface S is a surface on which the main body 11 (recording device 10) is installed.

The first caster 71 and the second caster 72, in plan view in the height direction Z, are located on one side in the front rear direction Y, that is, located at respective positions aligned in the width direction X on a side of the front wall 13. Specifically, the first caster 71 and the second caster 72 are aligned in the width direction X closer to a side of the front wall 13 than the core member 23 of the roll body 25 in a state of being housed in the housing unit 21. The first caster 71 and the second caster 72, in plan view in the height direction Z, are located at respective positions sandwiching the first holding unit 31 and the second holding unit 32 in the width direction. The third caster 73 and the fourth caster 74, in plan view in the height direction Z, are located on another side in the front rear direction Y, that is, located at respective positions aligned in the width direction X on a side of the rear wall 14. Furthermore, the first caster 71 and the fourth caster 74 are mutually aligned in the front rear direction Y. Furthermore, the second caster 72 and the third caster 73 are mutually aligned in the front rear direction Y.

The first caster 71 and the fourth caster 74 are located on an opposite side of the second side frame 62 with respect to the first side frame 61. The first caster 71, in plan view in the height direction Z, is located at a position overlapping with the drive unit 33 that drives to rotate the holding unit 30. The drive unit 33 is located at a position adjacent to the first side frame 61, and on a side of the first side wall 15. The fourth caster 74, as illustrated in FIG. 3, in plan view in the front rear direction Y, is located on an opposite side of the second caster 72 with respect to the first caster 71. In other words, in the width direction X, a distance from the first side frame 61 to the fourth caster 74 is greater than a distance from the first side frame 61 to the first caster 71.

The second caster 72 and the third caster 73 are located on an opposite side of the first side frame 61 with respect to the second side frame 62. The second caster 72 and the third caster 73 are aligned in the front rear direction Y in plan view in the height direction Z. The second caster 72 and the third caster 73 are located between the second side frame 62 and the mounting portion 57 in the width direction X. Note that, "between the second side frame 62 and the mounting portion 57 in the width direction X" refers to positions including positions overlapping with the mounting portion 57 in the height direction Z in plan view in the front rear direction Y.

Figure 6:
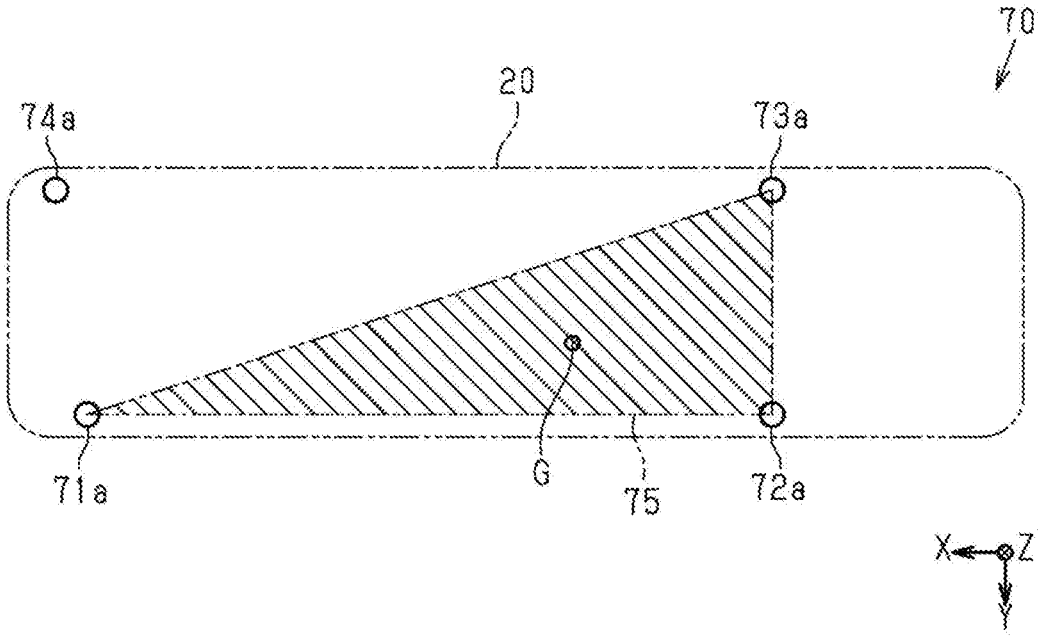
FIG. 6 is a diagram illustrating a positional relationship among contact units of respective support legs and a centroid of the recording device in plan view in the height direction.

As illustrated in FIG. 6, of the first caster 71 to fourth caster 74, the first caster 71 to third caster 73 are fixed support legs fixed to the base frame 20. The contact units included in the first caster 71 to third caster 73 respectively, are reference contact units 71*a*, 72*a*, and 73*a*, respectively. The fourth caster 74 is a movable support leg configured so that a position in the height direction Z is adjustable with respect to the base frame 20. A contact unit included in the fourth caster 74 is a movable contact unit 74*a*. Note that, in FIG. 6, each of the casters is rotatable with an axis along the height direction Z as a rotary axis, thus each of the contact units is denoted as a circle. The first caster 71 to third caster 73, in plan view in the height direction, form a reference plane 75 that is a triangular region coupling the reference contact units 71*a*, 72*a*, and 73*a*. The reference plane 75 is set in a region inside which a centroid G of the recording device 10 is located.

Figure 7:
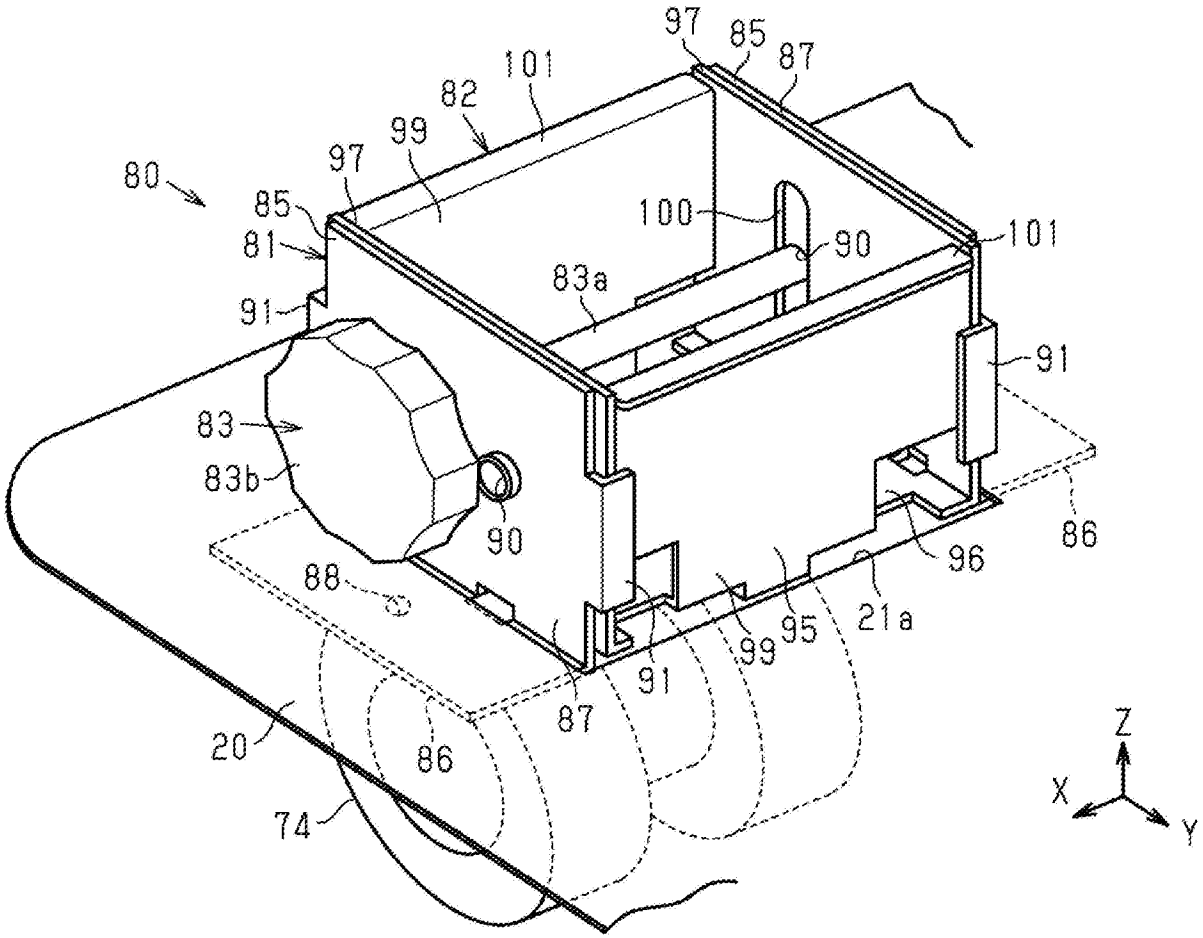
FIG. 7 is a perspective view illustrating an adjustment mechanism.
Figure 8:
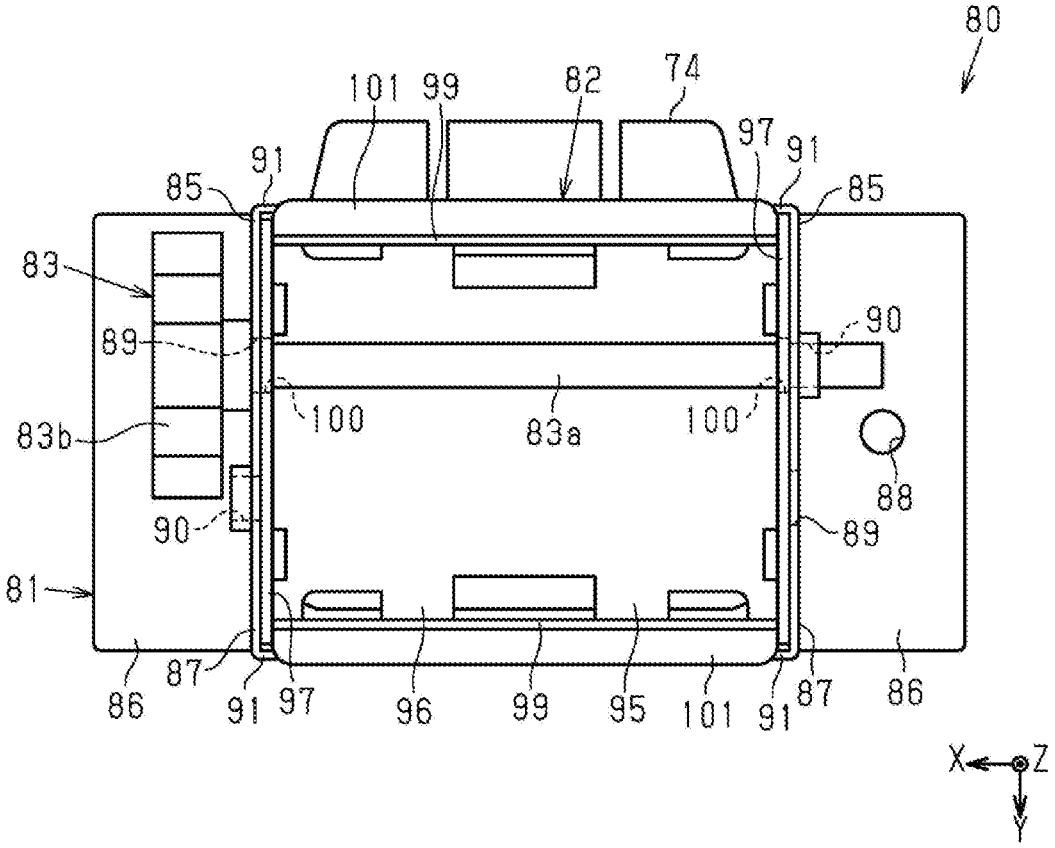
FIG. 8 is a plan view illustrating the adjustment mechanism in plan view in the height direction.

As illustrated in FIG. 7 and FIG. 8, the leg unit 70 includes an adjustment mechanism 80 that can adjust a position in the height direction Z of the fourth caster 74. The adjustment mechanism 80 includes a fixing portion 81 fixed to the base frame 20, a movable unit 82 to which the fourth caster 74 is fixed, and a fastening member 83 that fastens the movable unit 82 to the fixing portion 81. The fastening member 83 includes a shaft portion 83*a* being an external thread portion, and a head section 83*b* that can operate the fastening member 83. Note that, the adjustment mechanism 80 may be provided outside the housing 12, or may be provided inside the housing 12 so that the fastening member 83 can be operated through an openable and closable adjustment window provided in the housing 12.

The fixing portion 81 is constituted by a pair of clamping members 85. The clamping member 85 is, for example, manufactured by performing a bending process or a machining process on a metal base material such as SUS.

The clamping member 85 is, by bending the metal base material, formed with a coupling flange unit 86 coupled to the base frame 20, and a clamping unit 87 extending in the height direction Z from an end portion of the coupling flange unit 86. In other words, the coupling flange unit 86 is integrally formed with the clamping unit 87. The coupling flange unit 86 has a rectangular plate-like shape extending in a direction orthogonal to the height direction Z. The coupling flange unit 86 includes a fixing hole 88 through which a lockscrew (not illustrated) passes through that fixes the clamping member 85 to the base frame 20. The coupling flange unit 86 is fixed to the base frame 20 from a side of the installation surface S.

The clamping unit 87 has a rectangular plate-like shape extending in the height direction Z from one side (bent portion) of the coupling flange unit 86. The clamping portion 87 includes one clamping unit 87 (+X side) and another clamping unit 87 (−X side). The clamping unit 87 is disposed so as to protrude from the base frame 20 in the height direction Z through a mounting hole 21*a* formed in the base frame 20. In a flat surface included in the clamping unit 87, a through hole 89 through which the fastening member 83 can penetrate, and an internal thread hole 90 into which the shaft portion 83*a* of the fastening member 83 is threadable are formed. In FIG. 7 and FIG. 8, a flat surface parallel to the height direction Z included in the one clamping unit 87, is parallel to a flat surface parallel to the height direction Z included in the other clamping unit 87 in the width direction X. The through hole 89 is a round hole having a diameter that is somewhat larger than a diameter of the shaft portion 83*a* of the fastening member 83. A center line parallel to the width direction X passing through a center of the through hole 89 formed in the one clamping unit 87 overlaps with a center line parallel to the width direction X passing through a center of the internal thread hole 90 formed in the other clamping unit 87. In other words, the center of the through hole 89 formed in the one clamping unit 87, and the center of the internal thread hole 90 formed in the other clamping unit 87 pass through an identical center line. Additionally, in plan view in one +Z side of the height direction Z, the internal thread hole 90 is formed on a +Y side with respect to the through hole 89, in one clamping member 85 (+X side). At this time, in plan view in the one +Z side of the height direction Z, the internal thread hole 90 is formed on a −Y side with respect to the through hole 89, in another clamping member 85 (−X side). In other words, when focusing on the one clamping unit 87, the through hole 89 and the internal thread hole 90, in plan view in a thickness direction of the rectangular plate-like shaped clamping unit 87, are formed at respective positions that are line symmetrical, with a straight line orthogonal to a pair of opposing sides in the height direction Z, and passing through a center of the pair of sides (a straight line parallel to a flat surface of the one clamping unit 87) being an axis of symmetry. In other words, when focusing on the one clamping unit 87, in plan view in the thickness direction of the clamping unit 87, a distance between the center of the through hole 89 formed in the one clamping unit 87 and the straight line is, substantially equal to a distance between the center of the internal thread hole 90 formed in the one clamping unit 87 and the straight line. Accordingly, the pair of clamping members 85 can be commonalized.

In addition, the clamping member 85 includes a cantilevered guide portion 91 extending toward an opposite side of a direction in which the coupling flange unit 86 extends (width direction X) at each of end portions of the clamping unit 87 in a direction parallel to a flat surface included in the clamping unit 87 in which the through hole 89 and the internal thread hole 90 are aligned (front rear direction Y). The guide portion 91 is formed in a center portion of the clamping unit 87 in the height direction Z, and guides movement of the movable unit 82 in the height direction Z.

The movable unit 82 includes a movable member 95 to which the fourth caster 74 is fixed. The movable unit portion 82 is movable relative to the clamping unit 87 in the height direction Z. The movable member 95 has a quadrangular cylindrical shape having a bottom wall. The movable member 95 is, for example, manufactured by performing a bending process on a metal base material such as SUS.

The movable member 95 includes a bottom portion 96, a pair of clamped portions 97, and a pair of supporting portions 99. The bottom portion 96 (bottom wall) has a rectangular plate-like shape extending in a direction orthogonal to the height direction Z, and the fourth caster 74 is fixed to a side of the installation surface S.

The pair of clamped portions 97 each have a substantially rectangular plate-like shape. The clamped portion 97 extends in the height direction Z from each of a pair of opposing sides included in the bottom portion 96. The clamped portion 97 faces the clamping unit 87 of the clamping member 85 with the movable member 95 fastened to the fixing portion 81. The clamped portion 97 includes an elongated hole 100 extending in the height direction Z as a hole through which the shaft portion 83*a* of the fastening member 83 passes. A length of the elongated hole 100 along the front rear direction Y is shorter than a length of the elongated hole 100 along the height direction Z. The movable member 95 moves, in a range in which the shaft portion 83*a* of the fastening member 83 is movable within the elongated hole 100, between an uppermost position where the fourth caster 74 is disposed at a closest position to the base frame 20 and a lowermost position where the fourth caster 74 is disposed at a farthest position from the base frame 20. The adjustment mechanism 80 has a position such that the movable contact unit 74*a* of the fourth caster 74 is disposed on an identical plane to the reference plane 75, and the position is between the uppermost position and the lowermost position.

In a state of being fastened by the fastening member 83, the clamping unit 87 and the clamped portion 97 are in surface contact, and the clamped portion 97 is pressed inward the movable member 95 by the clamping unit 87. Accordingly, a frictional force is generated between the clamping unit 87 and the clamped portion 97, based on a pressing force with which the clamping unit 87 presses the clamped portion 97. The frictional force suppresses movement of the movable member 95 with respect to the fixing portion 81.

The pair of supporting portions 99 each have a substantially rectangular plate-like shape. The supporting portions 99 extend in the height direction Z from another pair of opposing sides included in the bottom portion 96, respectively. The supporting portion 99 is clamped by an end portion of one clamped portion 97 in the front rear direction Y, and an end portion of another clamped portion 97 in the front rear direction Y, and is located inside the pair of clamped portions 97. The supporting portion 99 enhances mechanical strength of the movable member 95 against the pressing force applied from the clamping unit 87 to the clamped portion 97. In addition, one supporting portion 99, on an end portion on a side opposite to the bottom portion 96 in the height direction Z, includes a cantilevered protruding portion 101 that protrudes in the front rear direction Y toward an opposite side of another supporting portion 99. The protruding portion 101, by enhancing mechanical strength of the supporting portion 99, enhances the mechanical strength of the movable member 95 against the pressing force described above. Further, the protruding portion 101 increases operability when a user moves the movable member 95 in the height direction Z, and engages with the guide portion 91 to prevent the movable unit 82 from falling out from the clamping unit 87.

Figure 9:
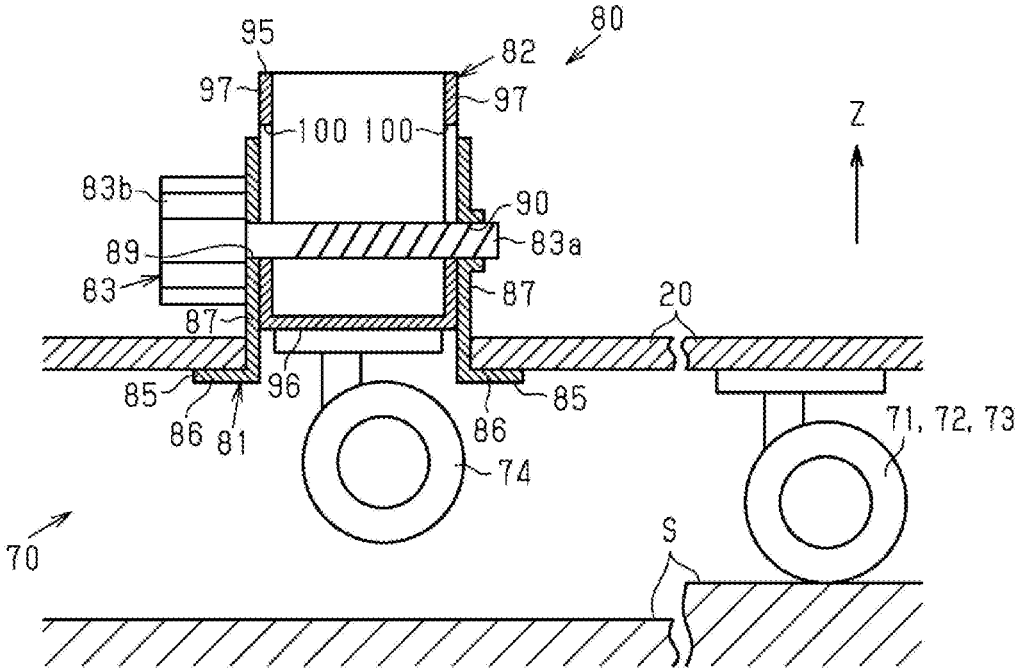
FIG. 9 is a diagram schematically illustrating a positional relationship among the respective support legs and an installation surface in the recording device before height adjustment.
Figure 10:
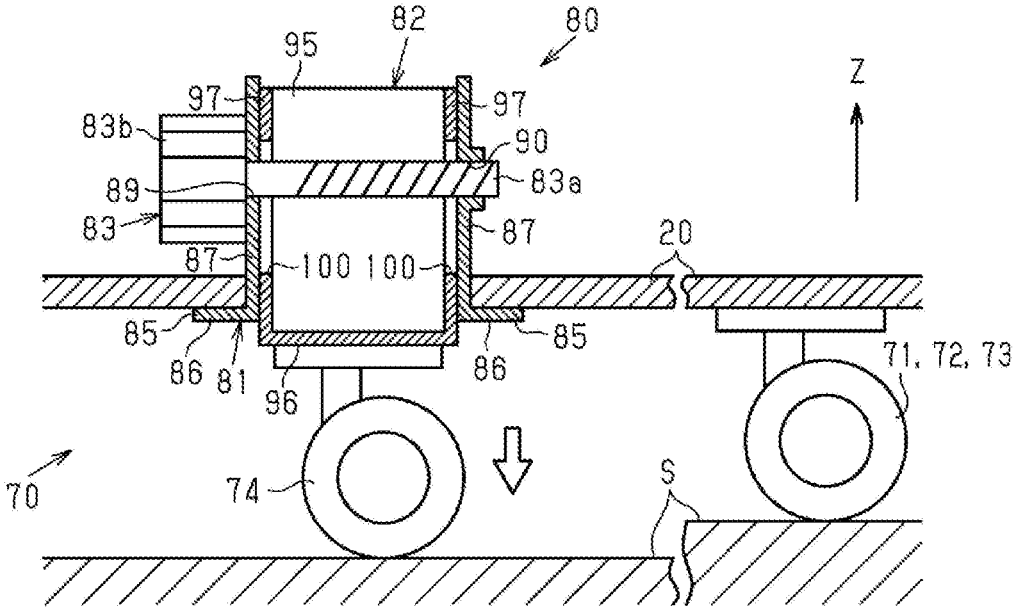
FIG. 10 is a diagram schematically illustrating a positional relationship among the respective support legs and the installation surface in the recording device after the height adjustment.

With reference to FIG. 9 and FIG. 10, an example of a method for installing the recording device 10 described above will be described. Here, a description will be given of a method for installing the recording device 10 by using a case as an example in which the recording device 10 installed at a certain location is moved to another location. Before moving, the recording device 10 is in a state of being supported by the first caster 71 to fourth caster 74. In addition, the adjustment mechanism 80 is in a state in which the movable unit 82 is fastened to the fixing portion 81 by the fastening member 83.

First, after the locking mechanism of each of the first caster 71 to fourth caster 74 is released, the recording device 10 is moved to a position to be installed. After moving the recording device 10, the adjustment mechanism 80 is operated to place the movable member 95 at the uppermost position. Specifically, after loosening the fastening member 83, the movable member 95 is operated and placed at the uppermost position, and then fastened again by the fastening member 83. Then, a position of the recording device 10 is adjusted so that the recording device 10 is supported by the first caster 71 to third caster 73 forming the reference plane 75, and the first caster 71 to third caster 73 are locked. Accordingly, the recording device 10 is supported at three points by the first caster 71 to third caster 73 respectively, so that posture thereof is stabilized regardless of unevenness of the installation surface S.

As illustrated in FIG. 9, in the recording device 10 in a three-point supported state, the fourth caster 74 is in a state of being separated from the installation surface S.

As illustrated in FIG. 10, when the fastening member 83 of the adjustment mechanism 80 is loosened in the recording device 10 in the three-point supported state, since the shaft portion 83*a* of the fastening member 83 is inserted through the elongated hole 100 extending in the height direction Z, the movable member 95 moves to a position where the fourth caster 74 contacts the installation surface S due to the movable member 95's own weight. Then, after the fastening member 83 is fastened again while the fourth caster 74 remains in contact with the installation surface S, the fourth caster 74 is locked. Accordingly, the recording device 10 is, regardless of the unevenness of the installation surface S, to be supported by, in addition to the first caster 71 to third caster 73, the fourth caster 74.

Effects of the present exemplary embodiment described above will be described.

(1) The leg unit 70 supporting the main body 11 from a side of the installation surface S includes, as the support legs each having the contact unit capable of contacting the installation surface S, the first caster 71 to third caster 73 that form the reference plane 75, and the fourth caster 74 configured to allow adjustment of the position in the height direction by the adjustment mechanism 80.

According to this configuration, the reference plane 75 formed by the first caster 71 to third caster 73 is a plane for which the relative position with respect to the main body 11 is defined. Thus, in the three-point supported state by the first 71 to third caster 73, by adjusting the position of the fourth caster 74, it is possible to bring the fourth caster 74 into contact with the installation surface S while the main body 11 is supported by the first caster 71 to third caster 73. Accordingly, the main body 11 can be supported at four points regardless of the unevenness of the installation surface S. As a result, influence from the unevenness of the installation surface S to the main body 11 can be reduced. For example, large distortion never occurs in the main body 11 even when the main body 11 is affected by the unevenness of the installation surface S. Thus, in the main body 11, flatness of the holder 36 supporting the medium 22 at a site where liquid is ejected is maintained high, and high printed image quality can be obtained.

(2) The main body 11, in plan view in the height direction Z, has the centroid inside the triangular reference plane 75 formed by the first caster 71 to third caster 73.

According to this configuration, the posture of the recording device 10 can be stabilized in the three-point supported state by the first caster 71 to third caster 73. Furthermore, the three-point supported state by the first caster 71 to third caster 73 after moving the recording device 10 can be easily achieved.

(3) The first caster 71 and the fourth caster 74, in plan view in the height direction Z, are located on the opposite side of the second side frame 62 with respect to the first side frame 61. The second caster 72 and the third caster 73, in plan view in the height direction Z, are located on the opposite side of the first side frame 61 with respect to the second side frame 62. According to this configuration, a load acting on the first caster 71 to fourth caster 74 via the first side frame 61 and the second side frame 62 can be effectively distributed.

(4) The main body 11 includes the mounting portion 57 that is located on the opposite side of the first side frame 61 with respect to the second side frame 62, and supported by the second side frame 62 via the first coupling frame 63. According to this configuration, a moment acting on the second side frame 62 due to the roll body 25's own weight, and a moment acting on the second side frame 62 due to the mounting portion 57's own weight are moments in respective opposite directions in the height direction Z. Accordingly, distortion of the second side frame 62 caused by the roll body 25's own weight and the mounting portion 57's own weight can be suppressed. As a result, distortion of the main body 11 due to the distortion of the second side frame 62 can be suppressed.

(5) The second caster 72, in plan view in the front rear direction Y, is located between the second side frame 62 and the mounting portion 57. According to this configuration, the second caster 72 can be disposed at a position closer to the second side frame 62. Accordingly, distortion of the base frame 20 caused by a moment, where the second caster 72 is a fulcrum point and a coupling portion of the second side frame 62 to the base frame 20 is a point of action, can be suppressed. As a result, distortion of the main body 11 due to the distortion of the base frame 20 can be suppressed.

(6) The main body 11 includes the maintenance unit 58 that is located on the opposite side of the first side frame 61 with respect to the second side frame 62, and supported by the second side frame 62 via the second coupling frame 64. The maintenance unit 58 includes a portion that overlaps with the mounting portion 57 in plan view in the height direction Z.

According to this configuration, compared to a case in which the maintenance unit 58 is located at a position farther from the mounting portion 57, a moment acting on the second side frame 62 due to the maintenance unit 58's own weight can be reduced. As a result, distortion of the second side frame 62 caused by the maintenance unit 58's own weight can be suppressed. Furthermore, a change of a position of the centroid G associated with mounting the maintenance unit 58 can be suppressed.

(7) The main body 11 includes the operation unit 59 at a position overlapping with the mounting portion 57 in the height direction Z. According to this configuration, the operation unit 59 can be disposed at a position closer to the centroid G. As a result, the main body 11 is less likely to be affected by a load associated with an operation of the operation unit 59.

(8) The drive unit 33 that drives the holding unit 30 is located on the opposite side of the second side frame 62 with respect to the first side frame 61, and is supported by the first side frame 61. The first caster 71 is located at the position overlapping with the drive unit 33 in the height direction Z.

According to this configuration, the first caster 71 can be disposed at a position closer to the first side frame 61. Accordingly, distortion of the base frame 20 caused by a moment, where the first caster 71 is a fulcrum point and a coupling portion of the first side frame 61 to the base frame 20 is a point of action, can be suppressed.

(9) The fourth caster 74, in plan view in the front rear direction Y, is located on an opposite side of the first side frame 61 with respect to the first caster 71.

According to this configuration, since the fourth caster 74 is located at a position farther from the first side frame 61, when a position of the fourth caster 74 is adjusted, the first side frame 61 can be prevented from becoming an obstacle. Furthermore, since a degree of freedom with respect to an installation position of the fourth caster 74 is increased, the fourth caster 74 can also be disposed at a position where the adjustment mechanism 80 is easily manipulated by the user as well.

(10) In plan view in the height direction Z, the second caster 72 and the third caster 73 are aligned in the front rear direction. According to this configuration, not only the second caster 72 but also the third caster 73 can be disposed at respective positions closer to the second side frame 62. Accordingly, distortion of the base frame 20 caused by a moment, where the third caster 73 is a fulcrum point and the coupling portion of the second side frame 62 to the base frame 20 is a point of action, can be suppressed.

(11) In the adjustment mechanism 80, since the shaft portion 83*a* of the fastening member 83 penetrates the elongated hole 100 formed in the movable member 95, the position of the fourth caster 74 can be adjusted by simply loosening the fastening member 83. In other words, the position of the fourth caster 74 can be easily adjusted. In addition, since the elongated hole 100 is formed in the movable member 95, the fastening member 83 never moves associated with movement of the movable member 95. Accordingly, the adjustment mechanism 80 can be reduced in size while ensuring a range of the movement of the movable member 95.

(12) When the fourth caster 74 contacts the installation surface S and the fastening member 83 is in a fastened state, a load in the height direction Z as a reaction force, that is, a load that causes the adjustment mechanism 80 to move in the height direction Z with respect to the base frame 20 acts on the adjustment mechanism 80. In this regard, the clamping member 85 includes the coupling flange unit 86 coupled to the base frame 20 from a side of the installation surface S. Accordingly, the adjustment mechanism 80 can receive the reaction force described above not only by the lockscrew but also by the coupling flange unit 86.

(13) The clamping member 85 is, when, at a position to which one clamping member 85 is rotated 180° with the height direction Z as an axis, another clamping member 85 is disposed, formed at a position where the through hole 89 and the internal thread hole 90 face each other between the one clamping member 85 and the other clamping member 85. According to this configuration, the pair of clamping members 85 can be constituted by respective members having identical structure. Accordingly, productivity of the clamping member 85, and workability for attachment of the clamping member 85 are improved. In addition, since the internal thread hole 90 is formed in the clamping member 85, a fastening force can be changed by simply operating the fastening member 83.

(14) The movable member 95 includes the pair of clamped portions 97 clamped by the pair of clamping members 85, and the pair of supporting portions 99 located inside the pair of clamped portions 97. According to this configuration, when the clamped portion 97 is pressed associated with fastening of the fastening member 83, the supporting portion 99 located inside the pair of clamped portions 97 functions like a pillar. As a result, the mechanical strength of the movable member 95 can be enhanced.

(15) The pair of supporting portions 99 each include the protruding portion 101 that protrudes outward on the end portion on the side opposite to the bottom portion 96. According to this configuration, the mechanical strength of the movable member 95 can be enhanced. Further, the operability when the user moves the movable member 95 in the height direction Z can be increased, and the movable unit 82 can be prevented from falling out by the engagement with the guide portion 91.

The exemplary embodiment described above may be modified and embodied as follows. The exemplary embodiment described above and modified examples below may be embodied in combination within a range in which a technical contradiction does not arise.

In the adjustment mechanism 80, it is sufficient that the elongated hole 100 is formed in one of the movable member 95 and the clamping member 85. Since the elongated hole 100 is formed in the clamping member 85, the movement of the movable member 95 can be checked by the movement of the fastening member 83.

The movable member 95 of the adjustment mechanism 80 is not limited to one with the quadrangular cylindrical shape having the bottom portion 96, and may be, for example, a solid member having the elongated hole 100.

It is sufficient that the fixing portion 81 of the adjustment mechanism 80 is a member that is fixed to the main body 11. Thus, the fixing portion 81 is not limited to one constituted by the pair of clamping members 85, and may be constituted by one member in which, for example, the internal thread hole 90 is formed.

In the adjustment mechanism 80, an internal thread portion into which the fastening member 83 is threaded is not limited to the internal thread hole 90 formed in the fixing portion 81. The adjustment mechanism 80 may be constituted to include a nut as the internal thread portion.

The recording device 10, in plan view in the height direction Z, may include the operation unit 59 at a position different from that of the mounting portion 57.

It is sufficient that, in the recording device 10, one of the first caster 71 to fourth caster 74 includes a movable contact unit. As such, in the recording device 10, for example, the first caster 71 may be provided on a support leg having a movable contact unit, and the second caster 72 to fourth caster 74 may be provided on respective support legs each having a reference contact unit.

It is sufficient that the first caster 71 and the fourth caster 74 are located, in plan view in the front rear direction, on the opposite side of the second side frame 62 with respect to the first side frame 61. Thus, both the first caster 71 and the fourth caster 74 may be, in plan view in the front rear direction, located at respective positions overlapping with the drive unit 33 in the height direction. Both the first caster 71 and the fourth caster 74 may be, in plan view in the front rear direction, located on an opposite side of the first side frame 61 with respect to the drive unit 33. The first caster 71 and the fourth caster 74 may be, in plan view in the front rear direction, located at respective positions aligned in the front rear direction. Additionally, the first caster 71 need not be aligned in the width direction with the second caster 72, or the fourth caster 74 need not be aligned in the width direction with the third caster 73.

It is sufficient that the second caster 72 and the third caster 73 are, in plan view in the front rear direction, located on the opposite side of the first side frame 61 with respect to the second side frame 62. Thus, at least one of the second caster 72 and the third caster 73 may be, in plan view in the front rear direction, located on an opposite side of the second side frame 62 with respect to the mounting portion 57. At least one of the second caster 72 and the third caster 73 may be, in plan view in the front rear direction, located on an opposite side of the second side frame 62 with respect to the maintenance unit 58. At least one of the second caster 72 and the third caster 73, in plan view in the front rear direction, may be located at a position overlapping with the mounting portion 57 in the height direction, or may be located at a position overlapping with the maintenance unit 58 in the height direction.

The recording device 10 is not limited to be configured to, in plan view in the height direction Z, have the centroid G inside the reference plane 75. In this configuration, a configuration is desirably adopted in which, in plan view in the height direction Z, the centroid G is in a quadrangular region formed by the first caster 71 to fourth caster 74.

The support leg having the contact unit is not limited to the caster. For example, a support leg having a movable contact unit may be a stand provided such that a position thereof can be adjusted in the height direction Z with respect to the base frame 20.

It is sufficient that the recording device 10 includes the holding unit 30 that rotatably holds the roll body 25 in which the medium 22 is wound around the core member 23 around the central axis of the core member 23, and performs recording by ejecting liquid from the recording head 39 onto the medium 22 drawn from the roll body 25. Thus, in the recording device 10, the number of the roll bodies 25 that can be held may be one, or may be three or more. Additionally, the holding unit 30 may also be disposed at a rear portion of the main body 11. Further, the recording device 10 may also include a winding device that winds the medium 22 after recording.

A leg unit may be a leg having a configuration described in JP-A-2007-196487. That is, a configuration may be adopted that includes two pillar portions disposed substantially perpendicular to an installation surface at a predetermined interval, a lateral beam portion that couples the two pillar portions to each other, two lateral rod portions fixed to lower portions of the two pillar portions respectively, and four casters of which two are supported by each of the two lateral rod portions. It is sufficient that a holding unit is supported by a supporting arm extending from the pillar portion, and that one of the four casters serves as a support leg having a movable contact unit. The main body 11 is supported on an upper portion of the leg unit via fastening, such as a bolt.

The recording device 10 may be a recording device that discharges or ejects liquid other than ink. A state of liquid ejected from the recording device as a small amount of liquid droplet may also include, a granular one, a tear shaped one, or one with a stringy trail. It is sufficient that the liquid described here is any material that can be discharged from the recording device. For example, it is sufficient that the liquid is a substance in a liquid phase, and includes a fluid body such as a liquid body with high or low viscosity, sol, gel water, other inorganic solvent, organic solvent, solution, liquid resin, liquid metal, or metallic melt. The liquid includes not only liquid as a substance in one state, but also particles of a functional material consisting of solid substances such as pigments or metal particles that are dissolved, dispersed, or mixed in a solvent. Representative examples of the liquid include the ink described in the above exemplary embodiment, liquid crystal, and the like. Here, the ink includes various liquid compositions such as a general water-based ink, a solvent ink, a gel ink, a hot-melt ink, and the like. Specific examples of the recording device include, for example, a device that discharges liquid including materials such as an electrode material and a color material used in manufacture of liquid crystal displays, electroluminescent displays, surface emitting displays, color filters and the like, in a dispersed or dissolved form. The recording device may be a device discharging bioorganic substances used for biochip manufacturing, a device used as a precision pipette and discharging liquid to be a sample, a printing apparatus, a micro dispenser, or the like. The recording device may be a device discharging lubricating oils to a precision machine such as a clock or a camera in a pinpoint manner, or a device discharging a transparent resin liquid such as an ultraviolet light curing resin or the like on a substrate for forming a tiny hemispherical lens, an optical lens, or the like used for an optical communication element, and the like. The recording device may be a device that discharges an etchant such as acid or alkali to etch a substrate or the like.

The recording device 10 may be a recording device of a type other than an ink-jet method. That is, as for the recording unit 35, an electrophotographic method including a photosensitive drum, an exposure unit, and a transfer unit may be adopted.

Contents derived from the above exemplary embodiment and modifications will be described.

The recording device is the recording device that includes the main body including the recording unit configured to rotatably hold the roll body in which the medium is wound around the core member around the central axis of the core member, and record on the medium drawn from the roll body, and the leg unit configured to support the main body from the installation surface on which the main body is installed, wherein the leg unit includes the contact units that can contact the installation surface at the positions different from each other, and the contact units include the three reference contact units that form the reference plane for which the relative position with respect to the main body is defined, and the one movable contact unit for which the position is adjustable in the height direction, which is the direction orthogonal to the reference plane.

According to the above-described configuration, the relative position of the reference plane formed by the reference contact units with respect to the main body is defined. Thus, by adjusting the position of the movable contact unit while the three reference contact units are brought into contact with the installation surface, the movable contact unit can be brought into contact with the installation surface while the three reference contact units remain in contact with the installation surface. Accordingly, the main body can be supported by the four contact units regardless of the unevenness of the installation surface. As a result, distortion due to the unevenness of the installation surface is less likely to occur on the main body, so the effect on the main body from the unevenness of the installation surface can be reduced.

In the recording device described above, the main body may have a centroid inside the reference plane in plan view in the height direction.

According to the above-described configuration, it is possible to stabilize posture of the recording device when the recording device is supported by the reference plane.

In the recording device described above, a configuration may be adopted in which, the main body includes a base frame supported by the leg unit, a first side frame that extends in the height direction from the base frame and rotatably supports a first holding unit that holds one end of the roll body, and a second side frame that extends in the height direction from the base frame and rotatably supports a second holding unit that holds another end of the roll body, and when a width direction of the recording device is defined as a direction in which the first side frame and the second side frame are aligned in plan view in the height direction, and a front rear direction of the recording device is defined as a direction orthogonal to the width direction in plan view in the height direction, the contact unit includes a first contact unit and a second contact unit aligned in the width direction on one side in the front rear direction in plan view in the height direction, and a third contact unit and a fourth contact unit aligned in the width direction on another side in the front rear direction in plan view in the height direction, and the first contact unit and the fourth contact unit are located on an opposite side of the second side frame with respect to the first side frame, and the second contact unit and the third contact unit are located on an opposite side of the first side frame with respect to the second side frame.

Since the four contact units are disposed as in the configuration described above, a load received by the base frame from the first side frame and the second side frame can be effectively distributed to each of the contact units. Accordingly, posture of the recording device after installation can be stabilized.

In the recording device, a configuration may be adopted in which, the recording unit includes a recording head that ejects liquid onto the medium, the main body includes a mounting portion on which a cartridge containing the liquid to be supplied to the recording head is mountable, the mounting portion is supported by the second side frame on an opposite side of the first side frame with respect to the second side frame, and at least one of the second contact unit and the third contact unit is located between the second side frame and the mounting portion in the width direction in plan view in the front rear direction.

According to the configuration described above, a moment acting on the second side frame due to the roll body's own weight and a moment acting on the second side frame due to the mounting portion's own weight are moments in respective opposite directions. Accordingly, distortion of the second side frame caused by the roll body's own weight and the mounting portion's own weight can be suppressed. In addition, since the contact unit is located between the second side frame and the mounting portion in plan view in the front rear direction, the contact unit can be disposed at a position closer to the second side frame. Accordingly, distortion of the base frame caused by a moment, where the contact unit is a fulcrum point and a coupling portion of the second side frame to the base frame is a point of action, can be suppressed. In other words, according to the configuration described above, distortion of the main body due to the distortion of the second side frame and the base frame can be suppressed.

In the recording device described above, a configuration may be adopted in which, the main body includes a maintenance unit that maintains the recording head, and the maintenance unit is located on an opposite side of the first side frame with respect to the second side frame, is supported by the second side frame, and overlaps with the mounting portion in plan view in the height direction.

According to the above-described configuration, since at least a part of the maintenance unit overlaps with the mounting portion in the height direction, compared to a case in which the maintenance unit is located at a position farther from the mounting portion with respect to the second side frame, a moment acting on the second side frame due to the maintenance unit's own weight can be reduced. Accordingly, distortion of the second side frame caused by the maintenance unit's own weight can be suppressed. As a result, distortion of the main body due to the distortion of the second side frame can be suppressed.

In the recording device described above, a configuration may be adopted in which, the main body includes an operation unit operated by a user, and the operation unit overlaps with the mounting portion in plan view in the height direction.

According to the above-described configuration, since the operation unit is located at a position overlapping with the mounting portion in the height direction, the operation unit can be disposed at a position closer to a centroid of the recording device. As a result, the main body is less likely to be affected by a load associated with an operation of the operation unit.

In the recording device, a configuration may be adopted in which, the main body includes a drive unit that drives to rotate the roll body, the drive unit is located on an opposite side of the second side frame with respect to the first side frame and supported by the first side frame, and the first contact unit is located at a position overlapping with the drive unit in the height direction.

According to the above-described configuration, since the first contact unit is located at the position overlapping with the drive unit in plan view in the height direction, the first contact unit can be disposed at a position closer to the first side frame. Accordingly, distortion of the base frame caused by a moment, where the first contact unit is a fulcrum point and a coupling portion of the first side frame to the base frame is a point of action, can be suppressed. As a result, distortion of the main body due to the distortion of the base frame can be suppressed.

In the recording device described above, a configuration may be adopted in which, in plan view in the front rear direction, the fourth contact unit is located on an opposite side of the second contact unit with respect to the first contact unit, and the fourth contact unit is the movable contact unit.

According to the above-described configuration, the fourth contact unit that is the movable contact unit is located at a position farther from the first side frame than the first contact unit. Thus, the first side frame can be prevented from becoming an obstacle when a position of the fourth contact unit is adjusted.

In the recording device described above, a configuration may be adopted in which, the leg unit includes an adjustment mechanism capable of adjusting a position of the movable contact unit, and the adjustment mechanism includes a fixing portion fixed to the main body, a movable unit including the movable contact unit, and a fastening member that fastens the movable unit to the fixing portion, and an elongated hole through which a shaft portion of the fastening member penetrates, and that extends in the height direction is formed in the movable unit.

According to the above-described configuration, by loosening the fastening member in a state in which the recording device is supported only by the three reference contact units, the position of the movable contact unit is changed due to the movable unit's own weight. As a result, the position of the movable contact unit can be easily adjusted. In addition, since the fastening member never moves by movement of the movable unit, it is possible to reduce in size of the adjustment mechanism while ensuring a range of movement of the movable unit.

What is claimed is:

1. A recording device, comprising:

a main body configured to rotatably hold, around a central axis of a core member, a roll body with a medium wound around the core member, the main body including a recording unit configured to perform recording on the medium drawn from the roll body; and a leg unit configured to support the main body from an installation surface at which the main body is installed, wherein the leg unit includes contact units configured to contact the installation surface at positions different from each other and configured to roll in conjunction with movement of the recording device, and the contact units include a first contact unit, a second contact unit and a third contact unit that form a reference plane, a relative position of the reference plane with respect to the main body being defined, and a fourth contact unit, a position thereof being adjustable in a height direction that is a direction orthogonal to the reference plane, the recording unit is configured to be reciprocally movable in a width direction that intersects the height direction, the first contact unit and the second contact unit are aligned in the width direction on one side in a front rear direction of the recording device in plan view in the height direction, and the third contact unit and the fourth contact unit are aligned in the width direction on another side in the front rear direction in plan view in the height direction, the front rear direction is a direction that intersects both of the height direction and the width direction, and a distance from the third contact unit to the fourth contact unit in the width direction is larger than a distance from the first contact unit to the second contact in the width direction.

2. The recording device according to claim 1, wherein the main body has a centroid inside the reference plane in plan view in the height direction.

3. The recording device according to claim 1, wherein the main body includes a base frame supported by the leg unit, a first side frame extending in the height direction from the base frame and rotatably supporting a first holding unit holding one end of the roll body, and a second side frame extending in the height direction from the base frame and rotatably supporting a second holding unit holding another end of the roll body, and the first side frame and the second side frame are aligned in the width direction in plan view in the height direction, and the first contact unit and the fourth contact unit are located on an opposite side of the second side frame with respect to the first side frame, and the second contact unit and the third contact unit are located on an opposite side of the first side frame with respect to the second side frame.

4. The recording device according to claim 3, wherein the recording unit includes a recording head for ejecting liquid onto the medium, the main body includes a mounting portion on which a cartridge containing the liquid to be supplied to the recording head is mountable, the mounting portion is supported by the second side frame on an opposite side of the first side frame with respect to the second side frame, and at least one of the second contact unit and the third contact unit is located between the second side frame and the mounting portion in the width direction in plan view in the front rear direction.

5. The recording device according to claim 4, wherein the main body includes a maintenance unit for performing maintenance of the recording head, and the maintenance unit is located on an opposite side of the first side frame with respect to the second side frame, is supported by the second side frame, and overlaps the mounting portion in plan view in the height direction.

6. The recording device according to claim 4, wherein the main body includes an operation unit operated by a user, and the operation unit overlaps the mounting portion in plan view in the height direction.

7. The recording device according to claim 3, wherein the main body includes a drive unit for driving the roll body to rotate, the drive unit is located on an opposite side of the second side frame with respect to the first side frame and supported by the first side frame, and the first contact unit is located at a position overlapping the drive unit in the height direction.

8. The recording device according to claim 1, wherein the leg unit includes an adjustment mechanism configured to adjust a position of the movable contact unit, and the adjustment mechanism includes a fixing portion fixed to the main body, a movable unit including the movable contact unit, and a fastening member for fastening the movable unit to the fixing portion, and in the movable unit an elongated hole through which a shaft portion of the fastening member extends, and that extends in the height direction is formed.

9. The recording device according to claim 1, wherein in plan view in the front rear direction, the fourth contact unit is located on an opposite side of the second contact unit with respect to the first contact unit.

* * * * *